US008137899B1

(12) United States Patent
Müller et al.

(10) Patent No.: US 8,137,899 B1
(45) Date of Patent: Mar. 20, 2012

(54) DATA SUPPORT WITH AN OPTICALLLY VARIABLE ELEMENT

(75) Inventors: Johann Müller, Poing (DE); Reinhard Plaschka, Windach (DE); Jürgen Zerbes, München (DE); Christoph Baldus, München (DE)

(73) Assignee: Giesecke & Devrient GmbH, Munich (DE)

( * ) Notice: Subject to any disclaimer, the term of this patent is extended or adjusted under 35 U.S.C. 154(b) by 1954 days.

(21) Appl. No.: 10/363,251

(22) PCT Filed: Sep. 6, 2001

(86) PCT No.: PCT/EP01/10288

§ 371 (c)(1),
(2), (4) Date: Jul. 15, 2003

(87) PCT Pub. No.: WO02/20280

PCT Pub. Date: Mar. 14, 2002

(30) Foreign Application Priority Data

Sep. 8, 2000 (DE) ..... 100 44 465

(51) Int. Cl.
*B42D 15/00* (2006.01)
*B42D 15/10* (2006.01)

(52) U.S. Cl. ..... 430/320; 283/72; 283/86; 283/84; 101/32

(58) Field of Classification Search ..... None
See application file for complete search history.

(56) References Cited

U.S. PATENT DOCUMENTS

| | | | | | |
|---|---|---|---|---|---|
| 1,002,600 | A | * | 9/1911 | Morris et al. | 283/70 |
| 4,033,059 | A | * | 7/1977 | Hutton et al. | 283/91 |
| 4,588,212 | A | * | 5/1986 | Castagnoli | 283/91 |
| 4,715,623 | A | * | 12/1987 | Roule et al. | 283/91 |
| 5,032,003 | A | * | 7/1991 | Antes | 359/567 |
| 5,074,596 | A | * | 12/1991 | Castagnoli | 283/91 |
| 5,094,575 | A | * | 3/1992 | Kieser et al. | 409/182 |
| 5,199,744 | A | * | 4/1993 | Shenton | 283/91 |
| 5,291,317 | A | * | 3/1994 | Newswanger | 359/15 |
| 5,396,559 | A | * | 3/1995 | McGrew | 380/54 |
| 5,428,479 | A | * | 6/1995 | Lee | 359/567 |
| 5,487,567 | A | * | 1/1996 | Volpe | 283/72 |
| 5,728,449 | A | * | 3/1998 | Steininger et al. | 428/195.1 |
| 6,036,233 | A | * | 3/2000 | Braun et al. | 283/91 |
| 6,176,521 | B1 | * | 1/2001 | Mancuso | 283/91 |
| 6,183,018 | B1 | * | 2/2001 | Braun et al. | 283/114 |

FOREIGN PATENT DOCUMENTS

| | | |
|---|---|---|
| CA | 1019012 | * 10/1977 |
| EP | 194042 | * 9/1986 |
| WO | 95/27925 | * 10/1995 |

* cited by examiner

*Primary Examiner* — Martin Angebranndt
(74) *Attorney, Agent, or Firm* — Bacon & Thomas, PLLC

(57) ABSTRACT

The invention relates to a data carrier with an optically variable structure having an embossed structure and a coating contrasting with the surface of the data carrier. The embossed structure and the coating are so combined that at least parts of the coating are completely visible upon perpendicular viewing but concealed upon oblique viewing so that a tilt effect arises upon alternate perpendicular and oblique viewing. The coating is executed uniformly and the embossed structure is divided into partial areas where different partial embossed structures are provided.

30 Claims, 8 Drawing Sheets

DATA SUPPORT WITH AN OPTICALLLY VARIABLE ELEMENT

This invention relates to a data carrier with an optically variable structure having an embossed structure and a coating contrasting with the surface of the data carrier, the embossed structure and the coating being so combined that at least partial areas of the coating are completely visible upon perpendicular viewing but concealed upon oblique viewing so that a tilt effect arises upon alternate perpendicular and oblique viewing. The invention further relates to an embossing die for producing such an optically variable structure.

It has been known for some time to equip data carriers, such as bank notes, papers of value, credit or ID cards or the like, with optically variable security elements, in particular optically variable diffraction structures, such as holograms. The protection of holograms from forgery is based on their different optical impression visually well recognizable upon a change of viewing angle, which cannot be reproduced by copying machines. Copying machines can only reproduce the appearance of the hologram at one certain viewing angle. A data carrier with such a hologram is known for example from EP 0 440 045 A2. This print proposes applying the hologram as a prefabricated element or an embossing to a lacquer layer applied to the data carrier.

However, there are also other optically variable security elements that can be provided on a data carrier. It is thus known for example from CA 1 019 012 to provide a bank note with a printed parallel line pattern in a partial area of its surface. To produce the optically variable effect, a line structure is additionally embossed into the data carrier in the area of the printed line pattern so as to form flanks that are only visible at certain viewing angles. Selective arrangement of the printed line pattern on the flanks of like orientation of the embossed line structure makes the line pattern visible upon oblique viewing of the flanks provided with the lines. Upon oblique viewing of the flanks on the back the line pattern is not recognizable.

The antiforgery effect of such embossed optically variable security elements can be further improved by producing additional visually recognizable effects by selectively changing the line pattern or embossed structure. Examples of such additional effects are described in WO 97/17211.

In known optically variable security elements the line print is fundamentally disposed on a flank of the embossed structure so that the reversal of contrast or tilt effect is very sharp but only occurs in a very narrow viewing angle range. For a visual check of known optically variable elements this precise viewing angle range must thus be found, so that these optically variable elements are not very suitable for a fast visual check.

The problem of the present invention is to improve these known embossed security elements not only with respect to forgery-proofness against reproduction but also with respect to visual checkability.

This problem is solved by the features of the independent claims. Developments are the subject matter of the subclaims.

According to the invention the optically variable structure consists of a print and an embossed structure superimposed on said print. The total area provided with print and embossed structure is divided into partial areas where either the print or the embossing is varied uniformly over the total surface. The other part (embossing or print) is executed in the same way in all partial areas, i.e. has the same regularities in all areas.

The invention will be explained in the following with reference to a constant print and varying embossed structure.

Different partial embossed structures according to the invention are present for example when the partial embossed structures are disposed with a phase shift, have different screen widths or are differently oriented, i.e. the partial embossed structures extend at an angle to each other, in the individual partial areas. A further possibility of producing different partial embossed structures is to dispose the partial embossed structures so as to be mutually shifted in the individual partial areas. The extending direction of the partial embossed structures remains the same.

Preferably, the partial embossed structures are executed as screen structures. The partial embossed structures can be triangular, but also trapezoidal, sinusoidal, semicircular or another shape. Preferably, the partial embossed structures are each executed as a line screen with constant screen width.

The print is preferably likewise formed as a screen structure, whereby the individual screen elements can be designed at will. However, a line screen with constant screen width is preferably used. According to a preferred embodiment, this line screen consists of printed lines of any color design. Printed screen and embossed structure are coordinated with each other, preferably such that the width of the printed screen lines is somewhat smaller than the flanks of the embossed structure lines. Printed screen and embossed structure normally extend parallel or largely parallel. Printed screen and embossed structure need not necessarily extend rectilinearly, they can also be formed as wavy lines, etc. The line widths are between 25 microns and 300 microns, preferably between 55 microns and 150 microns. If the line screen is composed of printed, spaced-apart lines, a ratio of about 1:1 is preferably selected for the ratio of printed to unprinted area. If a line width in the order of magnitude of about 100 microns is additionally selected, the lines can practically no longer be resolved by the eye and a homogeneous color effect arises. That is, the line screen is visually perceived only as a homogeneous colored surface. The lines can additionally be executed thicker in certain areas and represent for example a halftone image or another motif in this way. Alternatively, the lines can also have gaps in order to produce an additional visually recognizable pattern.

Screening the print is unnecessary if optically variable inks are used, i.e. inks having different optical effects depending on the angle of vision. These may be high-gloss, e.g. metallic, layers or inks that change their color effect themselves in angle-dependent fashion, as is the case e.g. with liquid-crystal pigment inks.

According to a preferred embodiment, the inventive optically variable structure consists of a print in the form of a printed line screen and an embossed structure superimposed on said screen whose partial embossed structures likewise consist of embossed line screens, which are for example mutually shifted from partial area to partial area. Due to the different arrangement of the partial embossed structures, the relative position between the printed line screen and the embossed line screen changes from partial area to partial area. Ideally, the printed lines are located completely on a flank of the first partial embossed structure in a first partial area. If the partial embossed structure of a second partial area is shifted relative to the first partial embossed structure, the printed line screen can for example cover the zeniths of the second partial embossed structure in said second partial area, i.e. the printed lines extend onto both flanks of the second partial embossed structure. In the next partial area the printed screen is again located completely on the flank of the partial embossed structure or is again shifted and thus disposed completely on the back flank. Corresponding variation of the shift of the different partial embossed structures can thus serve to produce any relative arrangements between the individual partial embossed structures and the print.

When this optically variable structure is viewed perpendicular to the data carrier surface, the viewer only recognizes the screenlike print. When the data carrier is tilted or the viewing angle changed, however, parts of the print are concealed by the embossed structure. Since the partial embossed structures are oriented differently relative to the print, different parts of the print are covered in the individual partial areas of the embossed structure. In some partial areas, larger parts of the unprinted spaces of the print formed as a line screen are covered for example, so that the viewer perceives this partial area as a darker surface in comparison with perpendicular viewing.

At a certain viewing angle all unprinted spaces of the line screen are concealed by the partial embossed structure in the above-described first partial area, so that the viewer perceives only the colored lines in this partial area. In other partial areas, however, parts or all of the printed lines are covered at the same viewing angle. These partial areas therefore appear to the viewer to be lighter or in the color of the data carrier in comparison with perpendicular viewing, since the share of perceptible unprinted spaces is greater. The contrasts are especially strong and thus striking if all unprinted spaces are covered in a partial area of the embossed structure and all printed lines of the line screen print in a directly adjoining one at a certain viewing angle.

At a certain viewing angle the viewer thus perceives the optically variable structure as areas contrasting with respect to brightness, color tone or color. Upon a change of viewing angle, the color effect or the brightness and thus also the contrast with the other partial areas changes at least in some partial areas since the printed line screen is not disposed precisely on the flanks of the partial embossed structures in all partial areas, and thus different shares of the printed line screen are shadowed even upon small changes of viewing angle. In this way the viewing angle range in which the optically variable structure shows a tilt effect is considerably enlarged.

The invention moreover has the advantage that the optically variable structures can be produced much more easily than optically variable structures known from the prior art despite the high forgery-proofness. Since application of the print and production of the embossed structure are effected in different working steps, tolerances necessarily occur in practice, which primarily lead to a parallel shift of print and embossed structure. That is, here, too, it can happen that parts of the print are disposed not only on the flanks but also in the area of the embossed structure zeniths. These tolerances can greatly dampen the tilt effect of known optically variable security elements, which is based on the sharp jump in contrast between the appearance upon perpendicular and upon oblique viewing.

In contrast, shifts between print and embossed structure are deliberately produced in the inventive optically variable security element. The frequent change of these shifts produced by the different partial embossed structures constantly causes new light-and-shadow relations or strong changes in contrast between the partial areas to arise upon a change of viewing angle, so that tilting creates the impression that the partial areas of different lightness and darkness or color are moving within the optically variable security element.

Additional tolerances between embossed structure and print that occur in production only superimpose this effect, not fundamentally altering the optical effect of the inventively protected surface area of the data carrier.

It is in principle also possible to realize the invention inversely, as mentioned above, i.e. making the embossed structure the same in all partial areas and providing different partial prints in the partial areas. However, this version is much more complicated to produce. Print deviations and tolerances are much more conspicuous and can disturb the general impression. Moreover, the variation of the print is also recognizable upon perpendicular viewing due to the printed line shift and can impair the total printed image of the data carrier or prevent a possibly desired camouflage of the partial areas upon perpendicular viewing. On the other hand, this effect can also be selectively utilized if the partial areas are to be recognizable at all viewing angles so that the viewer is better prepared for the tilt effects.

According to a further preferred embodiment, the optically variable structure consists of a printed line screen of constant screen width and an embossed structure whose partial areas form a two-dimensional matrix. The matrix has m partial areas in the horizontal direction and n partial areas in the vertical direction, where m, $n \geqq 1$, preferably m, $n \geqq 2$. The partial embossed structures provided in the partial areas are likewise executed as line screens with constant screen width. Preferably, the partial embossed structures and the line screen of the print have the same screen width. However, the width of an embossed line normally does not correspond to the width of the printed line since the printed line screen and the embossed structure can not always be applied in exact register and it is thus ensured that part of the lines of the print screen always come to lie on the flanks of the embossed screen at least far enough for a shadowing effect to occur at least in partial areas upon oblique viewing, this being responsible for the visually recognizable contrasts. Preferably, the width of an embossed line is 100 microns to 300 microns. The embossed lines can be directly adjacent or disposed at a distance in the range of about 10 microns to about 60 microns.

The partial areas or partial embossed structures of the matrix are advantageously directly adjacent and are recognizable solely due to their different relative position with respect to the print and the entailed visual effects. The different relative position between print and partial embossed structure can be produced in different ways.

Thus, the partial embossed structures of two adjacent partial areas can be mutually shifted. Preferably, the shift is a fraction of the screen width. A further possibility is to select different extending directions for adjacent partial embossed structures. Preferably, the partial embossed structures extend at an angle of 1 to 5°, preferably 1 to 3°, to each other.

According to a further embodiment, at least one of the partial areas of the inventive embossed structure has an information embossing in addition to the partial embossed structures. The information embossing is an embossing that preferably has the same design, e.g. the same screen elements and screen width, as the partial embossed structure but is shifted or at an angle relative to the partial embossed structure. Preferably, the information embossing is shifted by half a screen width or at an angle of 90° relative to the partial embossed structure. As explained above, the shift or different orientation between information embossing and partial embossed structures leads to different light/dark contrasts upon oblique viewing, so that the areas provided with the information embossing become visually recognizable. These areas preferably have the outline contours of characters, numerals, patterns or the like.

Further, at least one of the partial areas can only have partial embossed structures within the outline form of characters, patterns, images, etc. In this case the remaining area of the partial area is unembossed, or smoothed by the bearing surface of the embossing die and the bearing pressure necessary during embossing. The embossed information therefore stands out from the unembossed or smoothed surroundings as a matt "rough" surface structure. Here, too, the partial embossed structures preferably form a line screen, which preferably extends at an angle of 45° to the contour lines of the outline form. This has the advantage that a high number of embossed lines are disposed within the contour lines of the outline form, thereby ensuring a sufficient play of light and shadow or viewing-angle-dependent appearance. A thus designed partial area stands out in distinctly recognizable fashion in particular against the light.

The visual impression of the information embossing can be further accentuated if it is separated from the surrounding partial embossed structure by an unembossed, preferably narrow edge contour. The data carrier is preferably smoothed or calendered by the embossing tool in the area of this edge contour, so that a strongly reflective and shiny surface arises in this area. The unembossed edge contour is also very suitable for better visual accentuation of optically variable structures as are already known from the prior art.

Especially high-contrast and visually very striking optically variable structures are produced if the partial embossed structures are mutually shifted in adjacent partial areas by one third of the screen width and at least 50 percent of the partial embossed structures have an information embossing that is shifted relative to the partial structure by a fraction, in particular half, of the screen width. The other 50 percent of the partial embossed structures preferably have an information embossing extending at an angle of 90° to the partial embossed structure. The information embossing can have any outline forms. Thus, it can be present in the form of characters, patterns, images or the like. It is preferable to use characters yielding readable information. The embossed structure or the partial areas can also have any outline forms. The information embossings and/or partial areas are advantageously provided additionally with an unembossed edge contour.

According to a further embodiment, the inventive embossed structure has a plurality of directly adjacent partial areas where the extending direction of the partial embossed structures is varied by a small angle in each case, so that the optical impression of motion arises when the data carrier is tilted or upon a change of viewing angle. The extending direction is preferably changed by an angle of 1 to 3° in each case.

In a special embodiment, the color effect of the security element can be varied by a print comprising lines of different width and color, whereby these lines can be printed over each other. In a first step a line screen of spaced-apart lines all having the same color is printed. These lines are printed in a second printing operation with lines of smaller line width and a different color, preferably black. Preferably, half the line width of the first printed line is used and the second line disposed centrally over the first line.

However, the line screen can also consist of lines of different color that are directly adjacent and disposed alternatingly. It is also possible to use a checkerboard pattern composed of lines of different color, with spaced-apart lines of one color being disposed in each square of the checkerboard. Special effects can also be achieved by a line background wherein the lines are designed in different color within a certain area of the pattern.

Inks to be used for the print are not only conventional inks but also special inks with special-effect pigments, such as interference-layer or liquid-crystal pigments, magnetic pigments, electrically conductive pigments or luminescent pigments. Any metallic-looking inks are also possible. The print can likewise consist of metallic screen elements, which are applied to the data carrier by hot stamping for example. The term "print" also stands for all-over coatings, as mentioned above. In particular in the case of viewing-angle-dependent effect layers, such as interference-layer or liquid-crystal layers, diffraction structures or purely metallic layers, the combination with the inventive embossed structure can likewise lead to special, visually well recognizable effects.

In a special embodiment, the data carrier is a paper of value, in particular a bank note, to which the uniform coating according to the invention is preferably printed by offset. The embossed structure is then embossed by an embossing die in overlap with the inventive uniform coating. The embossing die used is preferably a steel intaglio printing plate into which the embossed structure is engraved in accordance with the desired form. The embossed structure can be transferred to the data carrier together with other printed images provided in the steel intaglio printing plate, which, unlike the embossed structure, are preferably ink-carrying.

However, any other embossing dies can also be used. Thus, the embossing dies can be produced for example by etching techniques or photopolymer washout processes. The term "embossing die" moreover includes embossing dies of any form, such as rotary embossing units.

Additional effects can be produced if the optically variable structure has, in addition to the inventive print, an optically variable coating. This may be a print of any design in optically variable inks. These optically variable inks preferably contain interference-layer pigments without body color or liquid-crystal pigments. This optically variable coating, which can be present in any outline form, e.g., as a pattern, character, logo or the like, is preferably applied by screen printing or flexography. The data carrier or data carrier material is preferably provided with this screen print in a first step. The inventive coating and embossed structure are then applied. The screen print background at the same time has a stabilizing effect on the embossed structure since the paper substrate loses part of its elasticity and can absorb less moisture.

To make the inventive embossed structure more resistant to environmental influences and damage, it is expedient to "freeze" the embossed structure by means of lacquering. For this purpose the "zeniths" of the embossed structures are coated with transparent lacquer and the depressions of the embossed structures filled at least partly with transparent lacquer. Lacquering is especially expedient if embossed structures with a triangular cross-sectional profile are used, since with this profile the apexes of the triangles might wear out especially fast during use. Such wear might considerably weaken the "tilt effect" occurring at alternate different viewing angles. Embedding the embossed structure in transparent lacquer or strengthening the relief by a lacquer coating can either prevent or at least reduce deformation of the embossing during use. Lacquering is preferably done using special transparent lacquers by different methods, preferably screen printing or flexography. To accelerate the drying phase of the preferably thick transparent lacquer layers, it is further preferable to use UV-curing lacquers. The lacquer can contain special feature substances such as luminescent substances, or special-effect pigments such as liquid-crystal or interference-layer pigments. It might also be expedient to first apply the lacquer layer, which can be matt or shiny, and thereover a layer containing the special-effect pigments. In this case it is also possible to apply the lacquer layer all over the note and only the lacquer layer provided with special-effect pigments in the area of the inventive security element.

Additionally or alternatively, the negative relief of the embossed structure present on the back of the data carrier can also be lacquered or filled to give the security element more stability. The lacquer can be applied by flexography or screen printing for example.

The invention and further embodiments and advantages will be illustrated hereinafter with reference to the Figures, in which.

Figure 1:
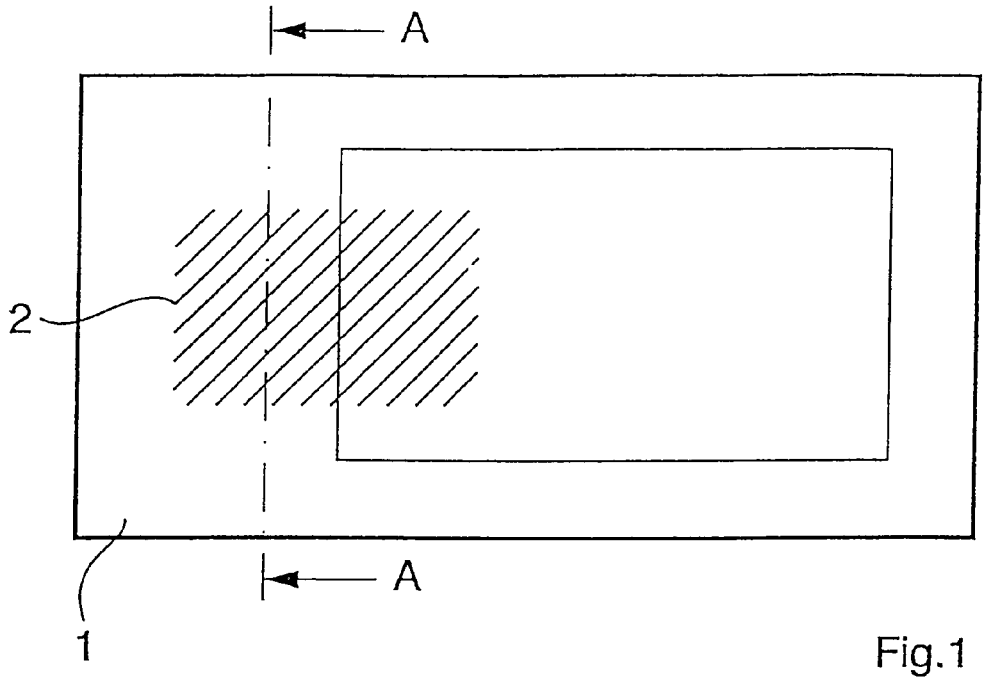
FIG. 1 shows an inventive data carrier.

FIG. 1 shows inventive data carrier 1 with optically variable structure 2. Optically variable structure 2 is a feature that is humanly testable without aids and is optionally used besides further security features for detecting the authenticity of the data carrier. The further features may be for example a security thread, watermark or the like. It is especially advantageous to use inventive optically variable structure 2 in bank notes, but also other papers of value such as shares, checks or the like. Labels or other elements for product protection can also be provided with such an optically variable structure.

Optically variable structure 2 consists fundamentally of an embossed structure and a print contrasting with the surface of the data carrier that are so combined that at least partial areas of the coating are completely visible upon perpendicular viewing but concealed upon oblique viewing.

Figure 2:
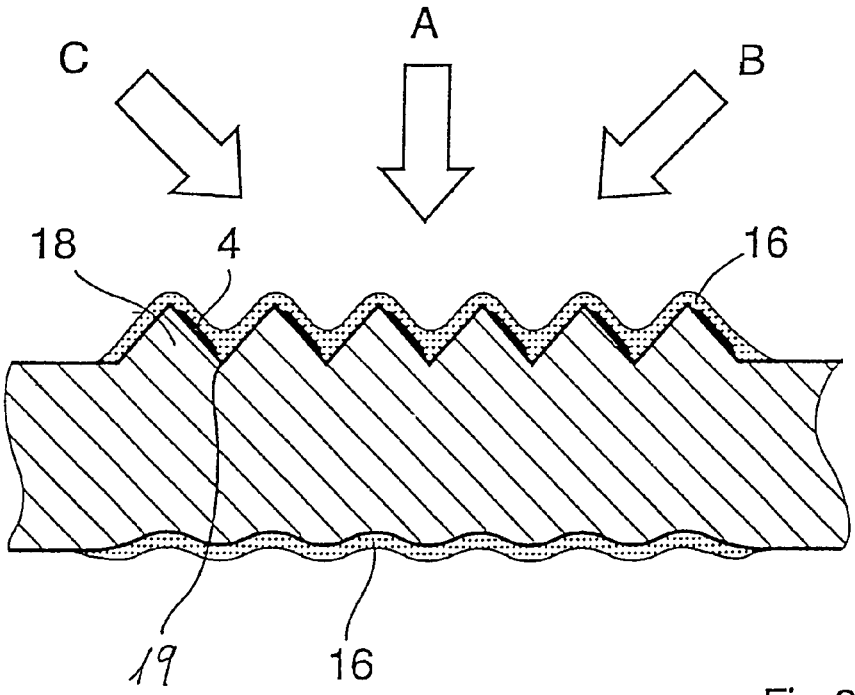
FIG. 2 shows a section along A-A in FIG. 1.

This principle is made clear with reference to the section along A-A shown in FIG. 2. Print 4 consists in the case shown here of line screen 4, and embossed structure 18 is also formed as a line screen structure. Embossed structure 18 is so positioned relative to printed screen 4 that the viewer only recognizes printed screen 4 upon perpendicular viewing from viewing direction A. Upon oblique viewing from viewing direction B the viewer is faced by the flank of embossed structure 18 that coincides with the printed lines of printed screen 4. The viewer therefore perceives an almost uniform colored print from viewing direction B. In viewing direction C the viewer is faced by the flanks of embossed structure 18 that coincide with the particular gap of printed screen 4. The viewer therefore perceives none or only a fraction of print 4 from viewing direction C.

Embossed structure 18 is preferably produced by means of a steel intaglio printing plate. For this purpose the negative of desired embossed structure 18 is engraved into the plate. During the printing operation, data carrier material 1 is pressed into the engraved areas of the plate and lastingly deformed. The high bearing pressure causes the embossing to stand out on the back of data carrier material 1 as well.

To protect embossing 18 from soiling and abrasion, it can be provided with protective layer 16. In the embodiment shown in FIG. 2 the embossing present on the back is also provided with protective layer 16. If optically variable structure 2 is only to be stabilized, it may also suffice to provide only the embossing on the back of data carrier 1 with protective layer 16. Protective layer 16 is preferably provided only in the area of optically variable structure 8. Protective layer 16 can be a transparent lacquer or a printing ink in the color tone of data carrier material 1. Protective layer 16 can be transferred to data carrier 1 in a separate operation after the embossing operation or simultaneously with the embossing. If a line intaglio printing plate is used as an embossing die, the plate is inked with the lacquer or ink in the area of the embossed structure before the printing operation.

Embossed structure 18 shown in FIG. 2 consists of directly adjacent triangular profiles, viewed in cross section. To protect the data carrier surface to be embossed, the triangular profiles can also be spaced slightly apart by providing horizontal connection bars in "valley area" 19 of the data carrier. This embodiment is not shown in FIG. 2.

Since tapered engraving tools are usually employed for producing the steel intaglio printing plates, greater engraving depth simultaneously means greater width of the engraved structure. For producing the inventive embossed structure, this means that greater embossing heights or amplitudes also entail greater screen widths. Since the data carrier material is additionally greatly stressed when it must be pressed into very deep engravings of the plate, the screen widths preferably used according to the invention are smaller than 300 microns, preferably smaller than 210 microns. Especially good results can be obtained with embossed lines with a width of about 170 microns. If the embossed lines are to be spaced apart, a distance of about 30 microns should preferably be provided.

Figure 3:
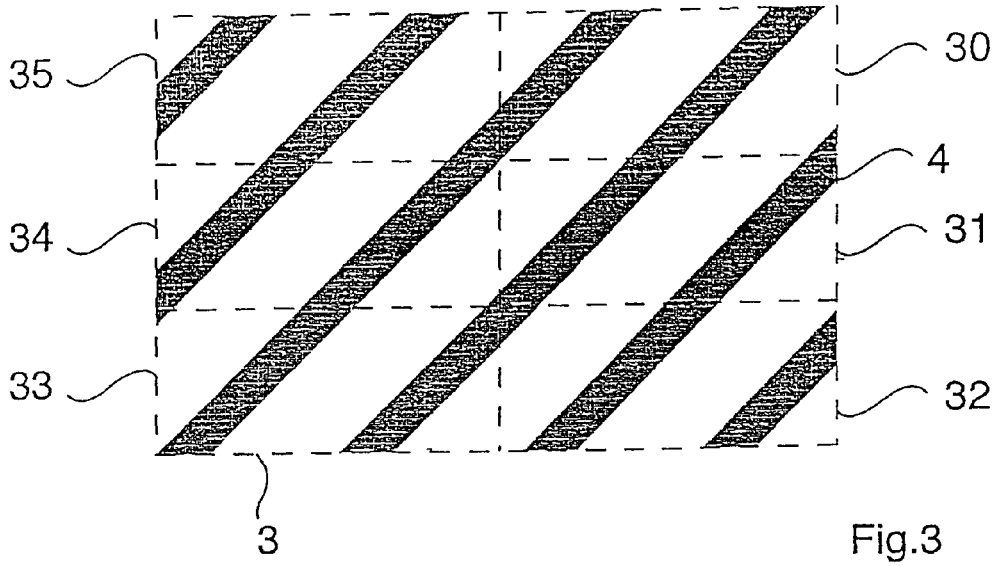
FIG. 3 shows the basic principle of the inventive optically variable structure.

FIG. 3 shows the basic structure of inventive optically variable structure 2 in a front view. It consists of print 4 shown in the present case as a line screen with constant screen width, the line screen consisting of spaced-apart printed lines. Embossed structure 3 is disposed in overlap with print 4, being indicated only by the dash-lined border for clarity's sake. Embossed structure 3 shown is divided into six partial areas 30, 31, 32, 33, 34, 35 where the partial embossed structures (not shown) are disposed. The partial areas are directly adjacent and form a two-dimensional matrix. Depending on the embodiment, this matrix can have n partial areas in the vertical direction and in partial areas in the horizontal direction, where n, $m \geqq 1$, preferably n, $m \geqq 2$. In the shown example, n=3 and m=2.

Since the embossing is applied after the print, register tolerances must normally be accepted. To ensure that total area 4 provided with the print is provided with desired embossed structure 3, it can be especially advantageous to select embossed structure 3 in somewhat greater dimensions than print 4. The reverse case with embossed structure 3 occupying a smaller surface than print 4 is of course equally possible.

The relative position of the partial embossed structures and print 4 varies within inventive embossed structure 3 from partial area to partial area so that the partial areas differ in color, color tone or brightness at a certain oblique viewing angle, and are thus visually recognizable as contrasting partial areas. Upon a change of viewing angle, the color effects and light/dark impressions of the partial areas vary.

Figure 4:
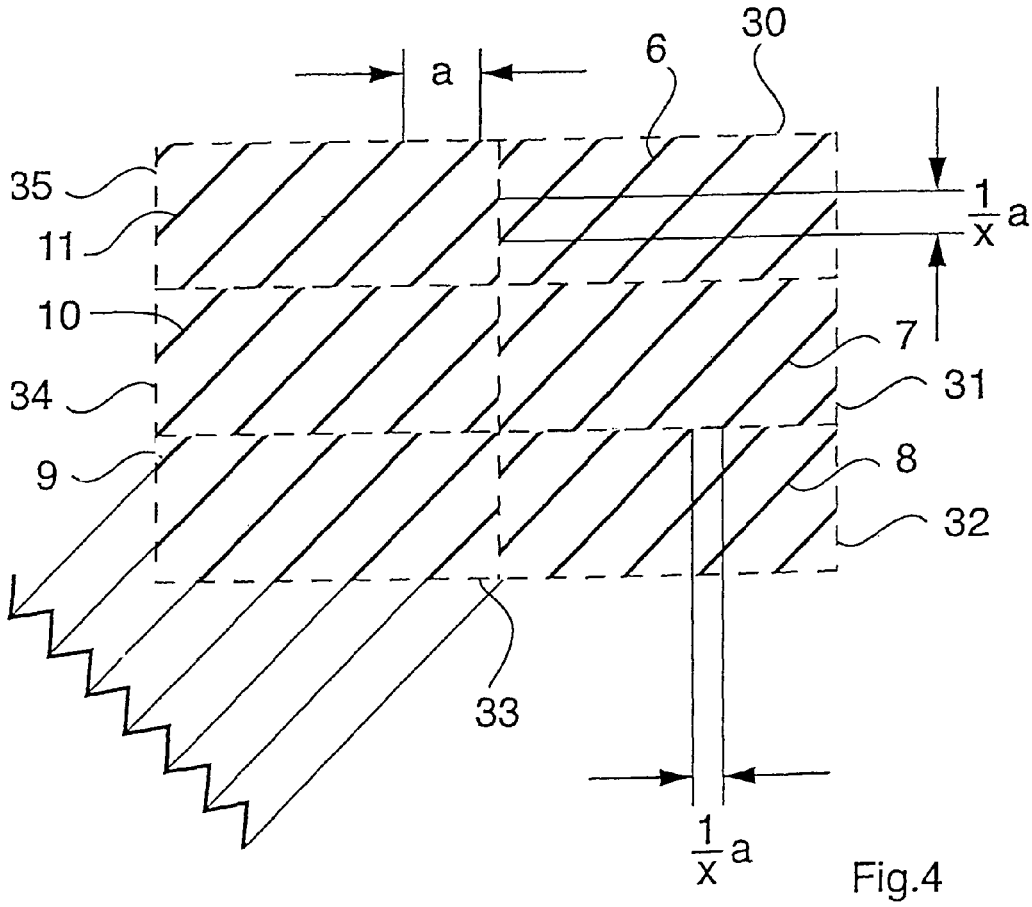
FIG. 4 shows an embodiment of the inventive embossed structure.

FIG. 4 schematically shows a special embodiment of embossed structure 3. It is composed of partial areas 30, 31, 32, 33, 34, 35 where different partial embossed structures 6, 7, 8, 9, 10, 11 are disposed. The oblique lines in FIG. 4 indicate the course and arrangement of particular partial embossed structure 6, 7, 8, 9, 10, 11. The shown lines mark the valleys of the embossed structure, as indicated by the drawing in the left area under the embossed structure, which shows the embossed structure in cross section. For clarity's sake, the zeniths of the embossed structure were not shown with lines in the Figures.

All partial embossed structures 6, 7, 8, 9, 10, 11 have same screen width a. However, two adjacent partial embossed structures 6, 7, 8, 9, 10, 11 are mutually shifted. In the shown example, the shift is fraction 1/x of screen width a. Two adjacent partial embossed structures are preferably mutually shifted by one third of screen width a.

Print 4 was omitted in FIG. 4 for clarity's sake. Since the arrangement of the partial embossed structures varies from partial area to partial area, however, the relative position between print 4 and particular partial embossed screen 6, 7, 8, 9, 10, 11 also varies accordingly. This results in frequently changing light/dark contrasts that clearly stand out and are well recognizable visually. If the shift is selected for example so that the partial embossed structures recur within the embossed structure, several partial areas show the same appearance at one viewing angle.

However, partial embossed structures 6, 7, 8, 9, 10, 11 of inventive embossed structure 3 need not fundamentally be mutually shifted by a fraction of screen width a. Any other shift is equally possible. Also, not all of partial embossed structures 6, 7, 8, 9, 10, 11 need be mutually shifted. It may be sufficient if only two of partial areas 30, 31, 32, 33, 34, 35 are provided with mutually shifted partial embossed structures 6, 7, 8, 9, 10, 11. The latter also need not necessarily be directly adjacent. Likewise, individual partial areas 30, 31, 32, 33, 34, 35 can be provided with partial embossed structures 6, 7, 8, 9, 10, 11 of different screen width a. The extending direction of individual partial embossed structures 6, 7, 8, 9, 10, 11 can also vary relative to the extending direction of adjacent partial embossed structures 6, 7, 8, 9, 10, 11. For example, partial embossed structure 6 can be disposed at an angle of 90° to partial embossed structure 11.

FIGS. 5 to 8 show different embodiments of partial area 30 of embossed structure 3 in a front view. All these embodiments have in common for reasons of clarity that print 4 is disposed on one of the flanks of partial embossed structure 6. This association results from the profile drawing at the lower edge of the particular Figure, which shows a detail of partial embossed structure 6 and print 4 in cross section. Moreover, partial embossed structures 6 are provided with additional changes that represent recognizable information. In most cases these are changes in the course or arrangement of the embossed structures. This additional information is called an information embossing.

Figure 5:
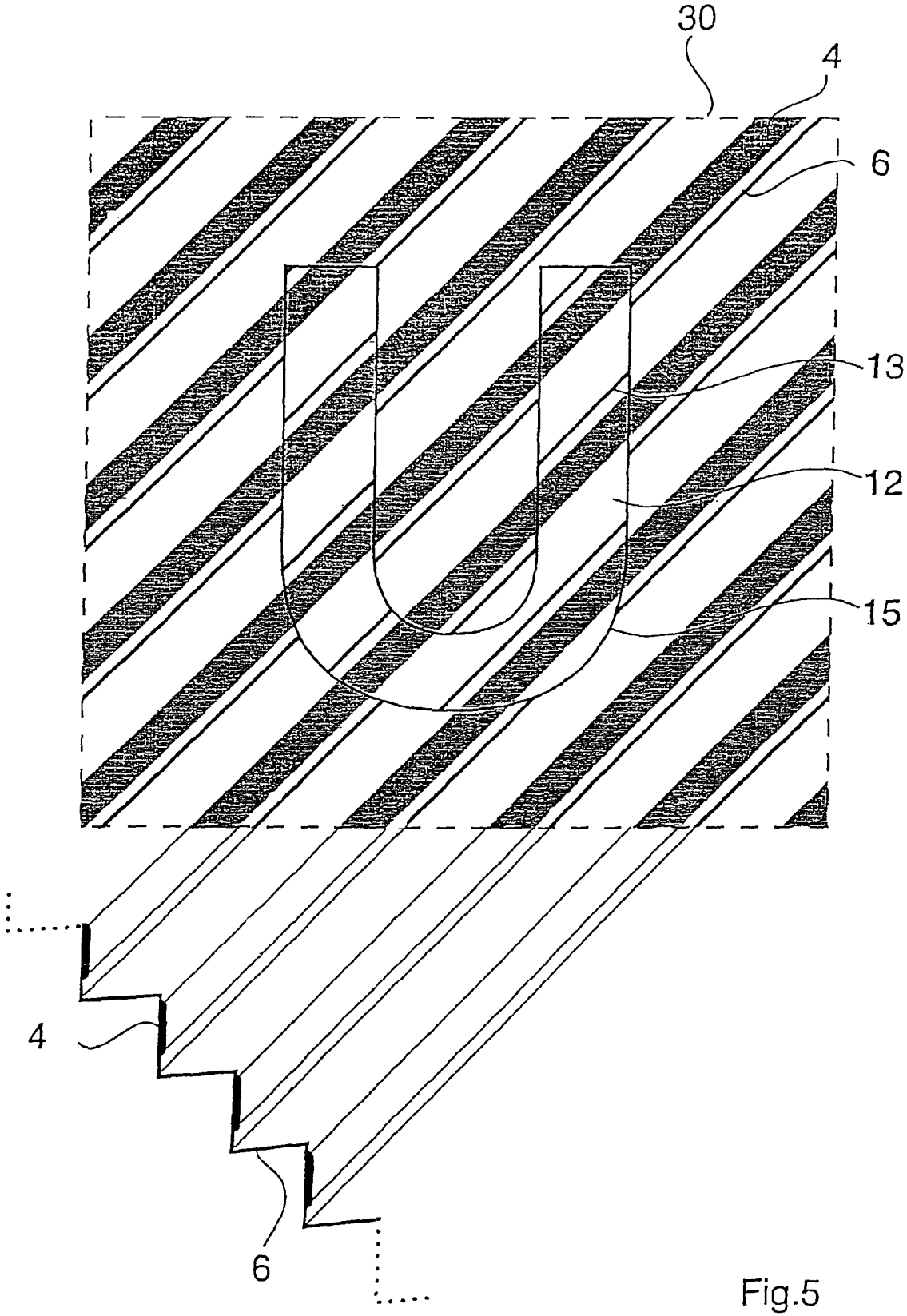
FIGS. 5 to 8 show different embodiments of an inventive partial area.

In FIG. 5, partial embossed structure 6 is interrupted in the area of information 12, which has the form of the letter "U" here. Within information 12, however, there is likewise information embossing 13, which has the same extending direction as partial embossed structure 6 but is shifted relative thereto. When this partial area is viewed from a direction in which the viewer is faced by flanks of partial embossed structure 6 provided with print 4, he perceives partial area 30 as a homogeneous colored surface in the color tone of print 4, which is interrupted in the area of information 12 by a lighter colored surface. This contrast causes information 12, here the letter "U," to be perceptible. The lighter color effect in the area of information 12 arises through the different relative position between information embossing 13 and print 4 in comparison with the surroundings. This is because, in the area of information 12, print 4 is no longer located precisely on a flank of the information embossing but also extends onto the zeniths, so that only part of unprinted intermediate area of printed line screen 4 is covered by information embossing 13 upon oblique viewing and therefore appears lighter.

Information embossing 13 is moreover separated from partial embossed structure 6 by unembossed area 15. In unembossed areas 15, which are shown as narrow black lines in the present examples but can also be executed much wider in practice, the data carrier is smoothed by the pressed-on embossing die during the embossing operation so that area 15 stands out as a light, shiny area upon oblique viewing. This principle can also be applied additionally in all other embodiments. Thus, it is possible to accentuate the edge contour of area 30 or the outline contours of information 12 by corresponding unembossed areas.

Figure 6:
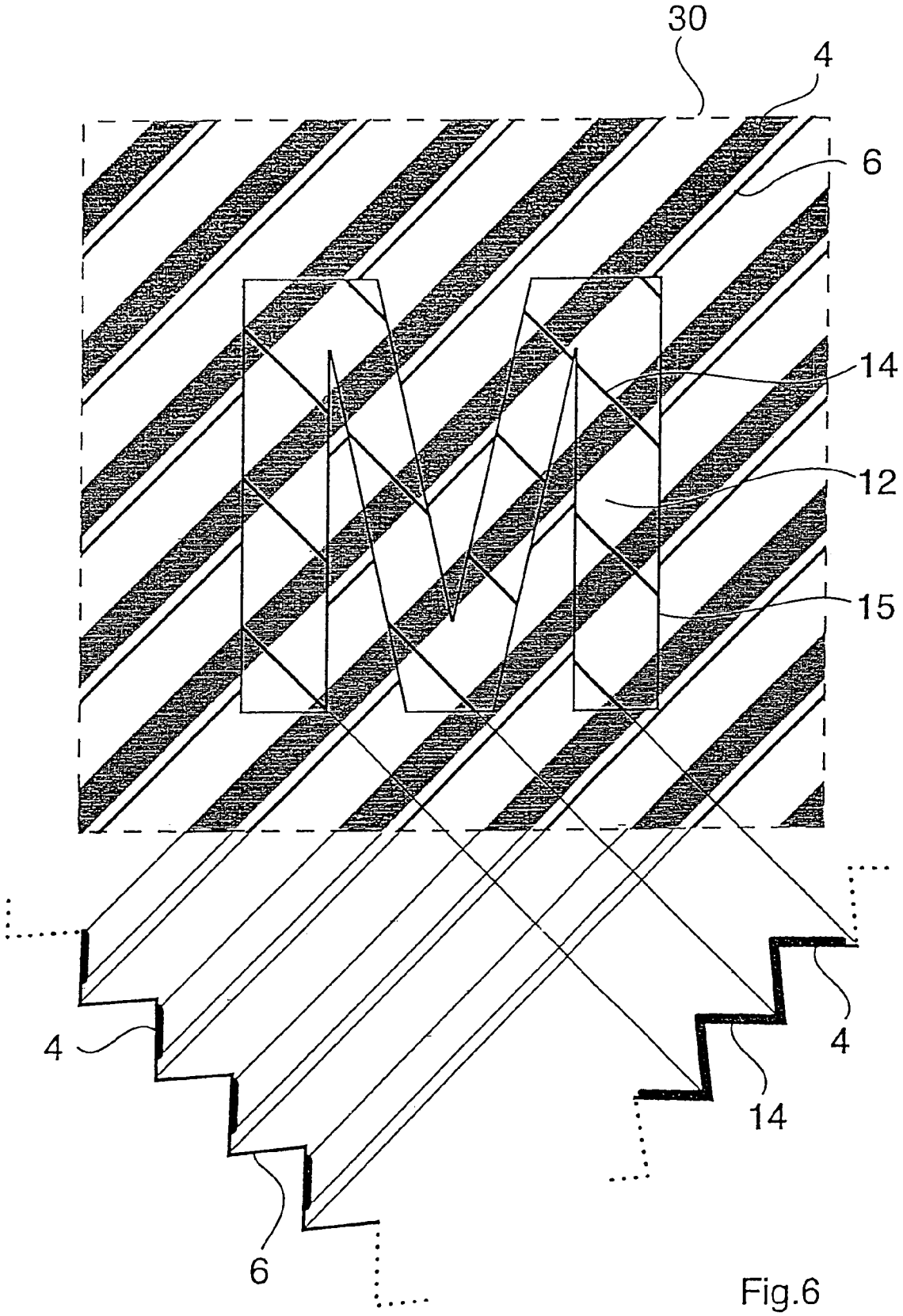

In FIG. 6, information embossing 14 is likewise provided in the area of information 12. It likewise has the same screen width as partial embossed structure 6 but is rotated in its extending direction by 90° relative to the extending direction of partial embossed structure 6. In the shown example, the lines of print 4 therefore extend over the zeniths and valleys of the information embossing, as indicated in the drawing in the lower right edge of FIG. 6. Here too, information 12 stands out from the surroundings as a lighter or darker area depending on the viewing angle, thereby being recognizable. Here too, information embossing 14 is separated from the partial embossed structure by unembossed edge contour 15.

Figure 7:
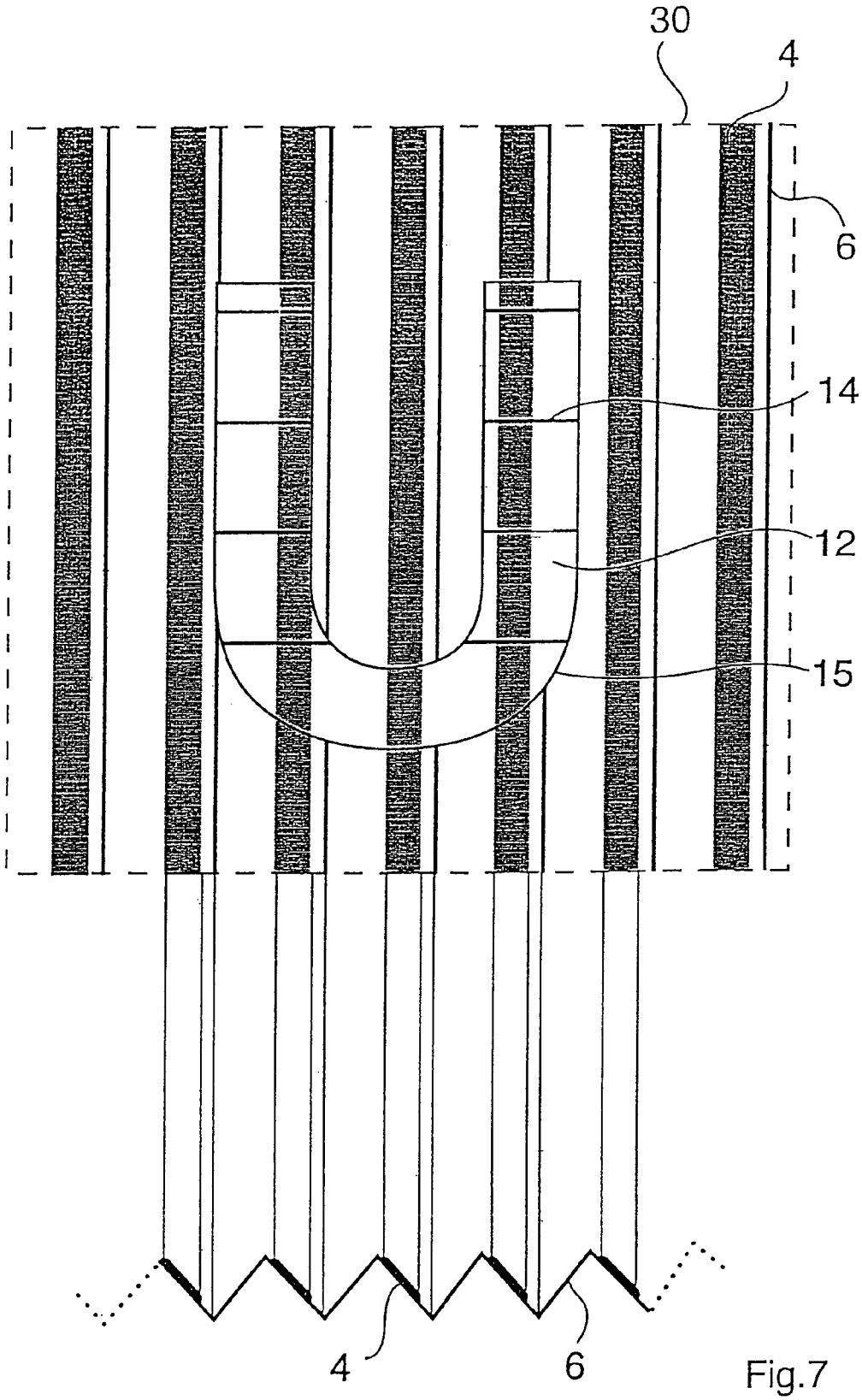

FIG. 7 shows a variant of the embodiment shown in FIG. 6. Here too, information embossing 14 extends at an angle of 90° to the surrounding partial embossed structure. However, the embossed lines are disposed parallel to the sides of partial area 30.

Figure 8:
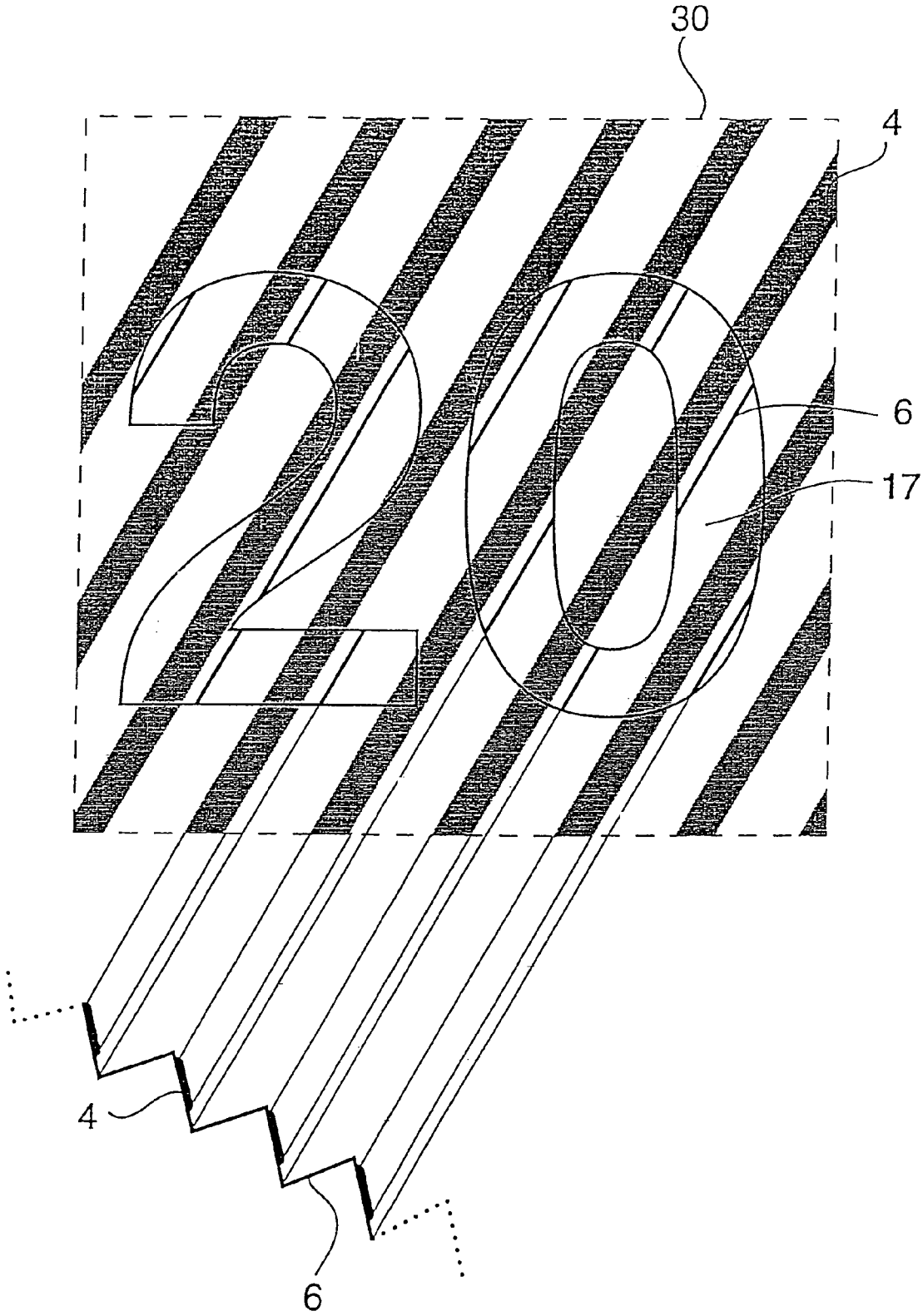

FIG. 8 shows partial area 30 that has partial embossed structure 6 only in the area of information 17. In this case, partial embossed structure 6 preferably extends at angle $\alpha$ to the outline contours of information 17. This ensures that as many embossed lines as possible are required for representing the information, thereby making the information distinctly recognizable. Angle $\alpha$ can be selected at will, but is preferably 45°.

The examples of partial area 30 shown in FIGS. 5 to 8 are of course transferable to the other partial areas at will. Any combinations of the shown embodiments can also be used in embossed structure 3.

According to a preferred embodiment of the inventive embossed structure, 50 percent of the partial areas are executed according to the variant shown in FIG. 5. That is, the embossed information structure is shifted relative to the partial embossed structure. According to a further preferred embodiment of the embossed structure, 50 percent of the partial areas are executed as shown in FIG. 6. That is, the embossed information structure extends at an angle of 90° to the partial embossed structure.

Figure 9:
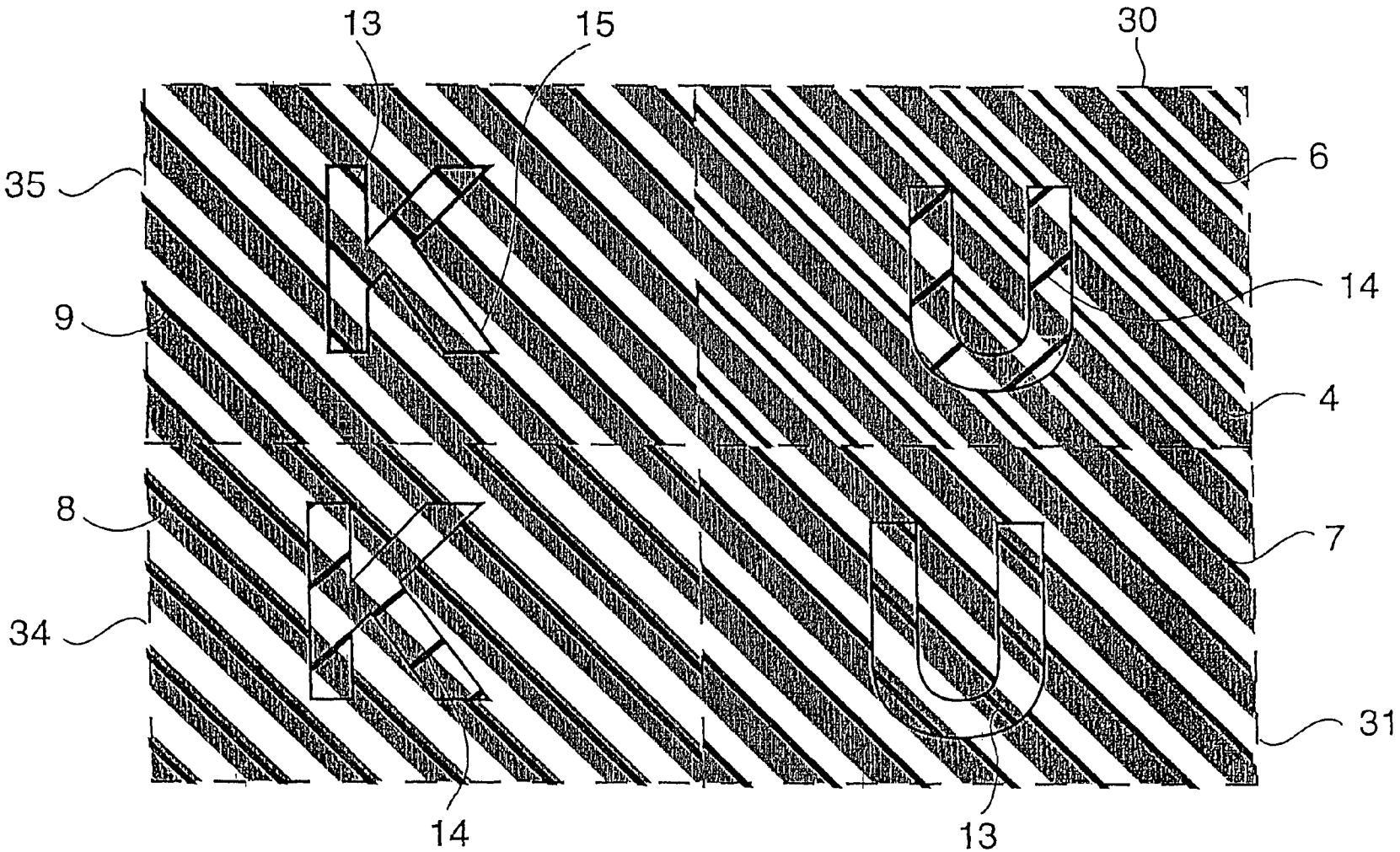
FIG. 9 shows a special embodiment of the inventive optically variable security element.

FIG. 9 shows an embodiment in which 50 percent of the partial areas are represented according to FIG. 5 and 50 percent of the partial areas according to FIG. 6. It consists of four partial areas 30, 31, 34, 35 where different partial embossed structures 6, 7, 8, 9 are disposed, while line screen 4 is the same for all partial areas. The embossed structure represents a matrix of m=2 and n=2 partial areas. Partial areas 30, 34 are executed according to the variant shown in FIG. 6 and partial areas 31, 35 according to the variant shown in FIG. 5. The different arrangement of partial embossed structures 6, 7, 8, 9 and embossed information structures 13, 14 causes the partial areas and information to be recognizable as areas of different lightness or darkness upon oblique viewing. Upon a change of viewing angle, the contrasts between the partial areas or information and the surroundings change, so that at least some of the partial areas appear lighter or darker and the total appearance of the optically variable security element changes. The represented information can be identical or else have different content in all partial areas. Upon viewing of this embossed structure at different viewing angles the information stands out distinctly in light form against a dark background, or vice-versa, in different partial areas.

Embossed structure 3 need not necessarily be composed of rectangular partial areas 30, 31, 32, 33, 34, 35. Partial areas 30, 31, 32, 33, 34, 35 can have any other outline forms. According to a preferred embodiment, total optically variable structure 2, or embossed structure 3, can have the outline form of a circle, semicircle, trapezoid, pattern, logo or the like within which partial areas 30, 31, 32, 33, 34, 35 are disposed with outlines adapted to this total outline contour of optically variable structure 2. The outline forms of individual partial areas 30, 31, 32, 33, 34, 35 can likewise vary.

Figure 10:
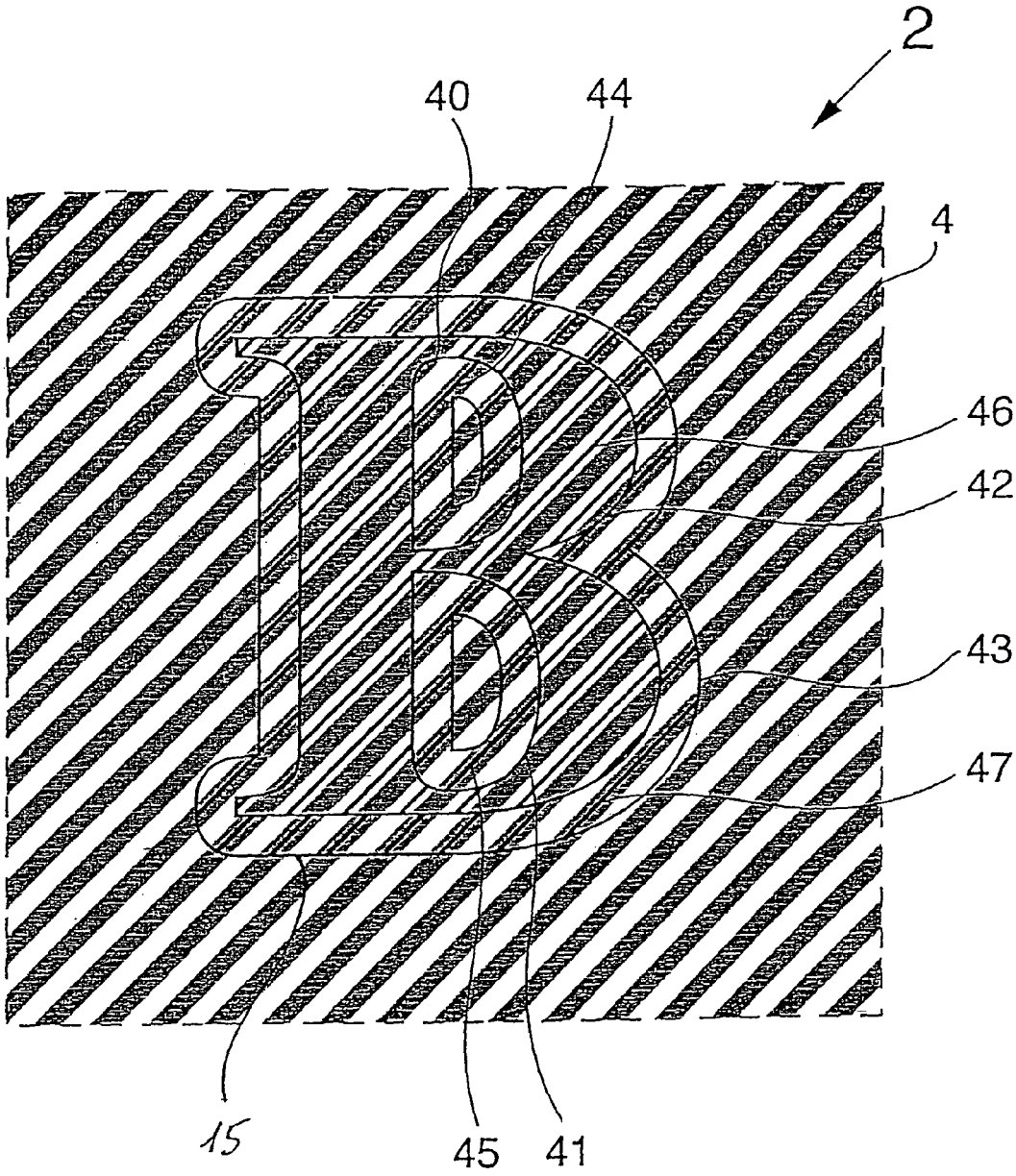
FIG. 10 shows a further embodiment of the inventive optically variable security element.

FIG. 10 shows a further variant of inventive optically variable security element 2. The embossed structure is present here in the form of the letter "B." The surface within the letter is divided into a plurality of partial areas 40, 41, 42, 43, which are provided with outline contour 15 in the Figure for better recognizability. Within partial areas 40, 41, 42, 43 partial embossed structures 44, 45, 46, 47 are provided which are mutually shifted.

The invention claimed is:

1. A data carrier with an optically variable structure comprising:

an embossed structure and a print contrasting with the surface of the data carrier, the embossed structure and the print being so combined that at least parts of the print are completely visible upon perpendicular viewing but concealed upon oblique viewing so that a tilt effect arises upon alternate perpendicular and oblique viewing, wherein the total area provided with print and embossed structure is divided into partial areas, wherein the partial areas divide the embossed structure into partial embossed structures, wherein different partial areas are provided with different partial embossed structures, wherein the partial embossed structures comprise embossed lines having flanks that are visible upon certain viewing angles, and wherein the print is a line screen that is constant across all partial areas, wherein the partial areas form two dimensional matrix of visually recognizable partial areas, the partial areas being visually recognizable due to a visual effect of the different partial embossed structures with respect to the print, the matrix having m partial areas in a horizontal direction and n partial areas in a vertical direction, the partial areas of the matrix being directly adjacent, where m, n≧1 and at least one of m and n>1.

2. The data carrier according to claim 1, wherein the line screen has a constant screen width.

3. The data carrier according to claim 2, wherein the line screen is selected from the group consisting of colored, spaced-apart lines and colored, directly adjacent lines.

4. The data carrier according to claim 1, wherein the partial embossed structures are executed as screen structures.

5. The data carrier according to claim 1, wherein the partial embossed structures are executed as line screens with constant screen width.

6. The data carrier according to claim 1, wherein the partial embossed structures and the print have the same screen width.

7. The data carrier according to claim 1, wherein at least some of the partial areas where the partial embossed structures are disposed are directly adjacent.

8. The data carrier according to claim 1, wherein the partial embossed structures are in shifted arrangement in at least two adjacent partial areas.

9. The data carrier according to claim 8, wherein the partial embossed structures are shifted by a fraction of the screen width.

10. The data carrier according to claim 9, wherein the fraction is one third of the screen width.

11. The data carrier according to claim 1, wherein the partial embossed structures have a different extending direction in two adjacent partial areas.

12. The data carrier according to claim 11, wherein the partial embossed structures extend at an angle of 1 to 5°, to each other.

13. The data carrier according to claim 12, wherein the angle is 1 to 3°.

14. The data carrier according to claim 11, wherein the partial embossed structures of a plurality of adjacent partial areas extend at a predetermined angle to each other so that the optical impression of motion arises upon a change of viewing angle.

15. The data carrier according to claim 1, wherein at least one of the partial areas additionally has an information embossing and the information embossing is shifted or disposed at an angle relative to the partial embossed structure.

16. The data carrier according to claim 15, wherein the angle is 90°.

17. The data carrier according to claim 1, wherein at least 50 percent of the partial embossed structures have an information embossing that is shifted relative to the partial embossed structure.

18. The data carrier according to claim 17, wherein the information embossing is shifted relative to the partial embossed structure by half the screen width.

19. The data carrier according to claim 1, wherein at least 50 percent of the partial embossed structures have an information embossing that extends at an angle of 90° to the partial embossed structure.

20. The data carrier according to claim 1, wherein the partial embossed structures of at least one partial area are disposed within the outline form of characters, patterns, images, etc.

21. The data carrier according to claim 20, wherein the partial embossed structures form a line screen that extends at an angle of 45° to the contour lines of the outline form.

22. The data carrier according to claim 1, wherein at least the partial embossed structures of a partial area and/or the embossed information structures of at least one partial embossed structure have an unembossed edge contour.

23. The data carrier according to claim 1, wherein the data carrier is provided with a protective layer at least in the area of the optically variable structure, the protective layer being disposed on the optically variable structure and/or the opposite surface of the data carrier.

24. The data carrier according to claim 1, wherein the data carrier is a paper of value.

25. The data carrier according to claim 1, wherein m, n≧2.

26. The data carrier according to claim 1, wherein said embossed lines have a width of at least about 100 μm.

27. A method for producing a data carrier with an optically variable structure comprising an embossed structure and a print contrasting with the surface of the data carrier, the method comprising the steps:

providing a data carrier or data carrier material;

providing an area of the data carrier or data carrier material with a print, the print being a line screen contrasting with the surface of the data carrier or data carrier material and being constant in the printed area;

embossing the data carrier or data carrier material in the area of the print by means of an embossing die, comprising an embossing die surface in which an embossing structure is engraved, the embossing structure being divided into partial areas defining partial embossing structures, wherein different partial areas are provided with different partial embossing structures, and wherein the partial embossed structures comprise embossed lines having flanks that are visible upon certain viewing angles, wherein the partial areas form two dimensional matrix of visually recognizable partial areas, the partial areas being visually recognizable due to the different partial embossed structures, the matrix having m partial areas in a horizontal direction and n partial areas in a vertical direction, the partial areas of the matrix being directly adjacent, where m, n≧1 and at least one of m and n>1.

28. The method according to claim 27, wherein the print is produced by offset.

29. The method according to claim 27, wherein the print is produced all over by means of optically variable layers.

30. The method according to claim 27, wherein said embossed lines have a width of at least about 100 μm.

* * * * *